US010337193B2

(12) United States Patent
Cook et al.

(10) Patent No.: US 10,337,193 B2
(45) Date of Patent: Jul. 2, 2019

(54) LOOSEFILL INSULATION BLOWING MACHINE HAVING A CHUTE SHAPE

(71) Applicant: Owens Corning Intellectual Capital, LLC, Toledo, OH (US)

(72) Inventors: David M. Cook, Granville, OH (US); Todd Jenkins, Newark, OH (US); Ryan S. Crisp, Lewis Center, OH (US); Shannon D. Staats, Ostrander, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 778 days.

(21) Appl. No.: 14/993,376

(22) Filed: Jan. 12, 2016

(65) Prior Publication Data

US 2016/0305133 A1 Oct. 20, 2016

Related U.S. Application Data

(60) Provisional application No. 62/147,171, filed on Apr. 14, 2015.

(51) Int. Cl.

| | |
|---|---|
| ***B02C 18/00*** | (2006.01) |
| ***E04F 21/08*** | (2006.01) |
| ***B02C 18/22*** | (2006.01) |

(52) U.S. Cl.

CPC ..... *E04F 21/085* (2013.01); *B02C 18/2216* (2013.01); *B02C 18/2291* (2013.01)

(58) Field of Classification Search

CPC . B02C 18/2291; B02C 18/2216; E04F 21/085

USPC ..... 241/605, 60, 225, 101.4

See application file for complete search history.

(56) References Cited

U.S. PATENT DOCUMENTS

| | | | | |
|---|---|---|---|---|
| 2,291,871 A | | 8/1942 | Bokum et al. | |
| 2,721,767 A | | 10/1955 | Kropp | |
| 2,989,252 A | | 6/1961 | Babb | |
| 3,051,398 A | * | 8/1962 | Babb | B02C 13/06 19/80 R |
| 3,314,732 A | | 4/1967 | Hagan | |
| 3,727,846 A | | 4/1973 | Rader | |
| 4,129,338 A | | 12/1978 | Mudgett | |
| 4,236,654 A | | 12/1980 | Mello | |
| 4,337,902 A | | 7/1982 | Markham | |

(Continued)

*Primary Examiner* — Faye Francis

(74) *Attorney, Agent, or Firm* — MacMillan, Sobanski & Todd, LLC

(57) ABSTRACT

A machine for distributing blowing insulation material is provided. The machine includes a chute having an inlet portion and an upper portion. The inlet portion is configured to receive a package of compressed loosefill insulation material. The upper portion extends from the inlet portion. The inlet portion and the upper portion have cross-sectional shapes and sizes that closely correspond to a cross-sectional shape and size of the package of compressed loosefill insulation material. A lower unit is configured to receive the loosefill insulation material exiting the chute. The lower unit includes a plurality of shredders and a discharge mechanism. The discharge mechanism is configured to discharge conditioned loosefill insulation material into an airstream. The cross-sectional shape and size of the inlet portion and the upper portion are configured to direct an expansive force of the compressed loosefill insulation material in a direction toward the lower unit.

12 Claims, 5 Drawing Sheets

(56) References Cited

U.S. PATENT DOCUMENTS

| | | | |
|---|---|---|---|
| 4,381,082 | A | 4/1983 | Elliott et al. |
| 4,978,252 | A | 12/1990 | Sperber |
| 5,462,238 | A | 10/1995 | Smith et al. |
| 5,639,033 | A | 6/1997 | Miller et al. |
| 5,647,696 | A | 7/1997 | Sperber |
| 5,829,649 | A | 11/1998 | Horton |
| 6,109,488 | A | 8/2000 | Horton |
| D568,458 | S | 5/2008 | Evans et al. |
| 7,520,459 | B2 | 4/2009 | O'Leary |
| 7,819,349 | B2 | 10/2010 | Johnson et al. |
| 7,938,348 | B2 | 5/2011 | Evans et al. |

* cited by examiner

LOOSEFILL INSULATION BLOWING MACHINE HAVING A CHUTE SHAPE

RELATED APPLICATIONS

This application claims priority from pending U.S. Provisional Patent Application No. 62/147,171, filed Apr. 14, 2015, the disclosure of which is incorporated herein by reference in its entirety.

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that can condition the loosefill insulation material to a desired density and feed the conditioned loosefill insulation material pneumatically through a distribution hose. Blowing insulation machines typically have a funnel-shaped chute or hopper for containing and feeding the blowing insulation material after the package is opened and the blowing insulation material is allowed to expand.

It would be advantageous if insulation blowing machines could be improved to make them easier to use.

SUMMARY

The above objects as well as other objects not specifically enumerated are achieved by a machine for distributing blowing insulation material from a package of compressed loosefill insulation material. The machine includes a chute having an inlet portion and an upper portion. The inlet portion is configured to receive the package of compressed loosefill insulation material. The upper portion extends from the inlet portion. The inlet portion and the upper portion have cross-sectional shapes and sizes that closely correspond to a cross-sectional shape and size of the package of compressed loosefill insulation material. A lower unit is configured to receive the compressed loosefill insulation material exiting the chute. The lower unit includes a plurality of shredders and a discharge mechanism. The discharge mechanism is configured to discharge conditioned loosefill insulation material into an airstream. The cross-sectional shape and size of the inlet portion and the upper portion are configured to direct an expansive force of the compressed loosefill insulation material in a direction toward the lower unit.

There is also provided a machine for distributing blowing insulation material from a package of compressed loosefill insulation material. The machine includes a chute having an inlet portion, an upper portion and a throat portion. The inlet portion is configured to receive the package of compressed loosefill insulation material. The upper portion extends from the inlet portion to the throat portion and the throat portion extends from the upper portion. The inlet portion, the upper portion and the throat portion have cross-sectional shapes and sizes that closely correspond to a cross-sectional shape and size of the package of compressed loosefill insulation material. The lower unit is configured to receive the compressed loosefill insulation material exiting the chute. The lower unit includes a plurality of shredders and a discharge mechanism. The discharge mechanism is configured to discharge conditioned loosefill insulation material into an airstream. The cross-sectional shapes and sizes of the inlet portion, the upper portion and the throat portion are configured to direct an expansive force of the compressed loosefill insulation material in a direction toward the lower unit.

There is also provided a machine for distributing blowing insulation. The machine includes a chute having an inlet portion and an upper portion. The inlet portion is configured to receive a package of compressed loosefill insulation material. The package includes a body of compressed loosefill insulation material within a protective covering. The loosefill insulation material is compressed in a radially inward direction toward a longitudinal axis. The upper portion extends from the inlet portion. The inlet portion and the upper portion have cross-sectional shapes and sizes that closely correspond to a cross-sectional shape and size of the package of compressed loosefill insulation material. A lower unit is configured to receive the compressed loosefill insulation material exiting the chute. The lower unit includes a plurality of shredders and a discharge mechanism. The discharge mechanism is configured to discharge conditioned loosefill insulation material into an airstream. The cross-sectional shapes and sizes of the inlet portion and the upper portion are configured to constrain expansive forces of the compressed loosefill insulation material in radially lateral and upward directions and allow expansive forces in a direction toward the lower unit.

Various objects and advantages of the loosefill insulation blowing machine having a chute shape will become apparent to those skilled in the art from the following detailed description, when read in light of the accompanying drawings.

DETAILED DESCRIPTION OF THE INVENTION

Figure 1:
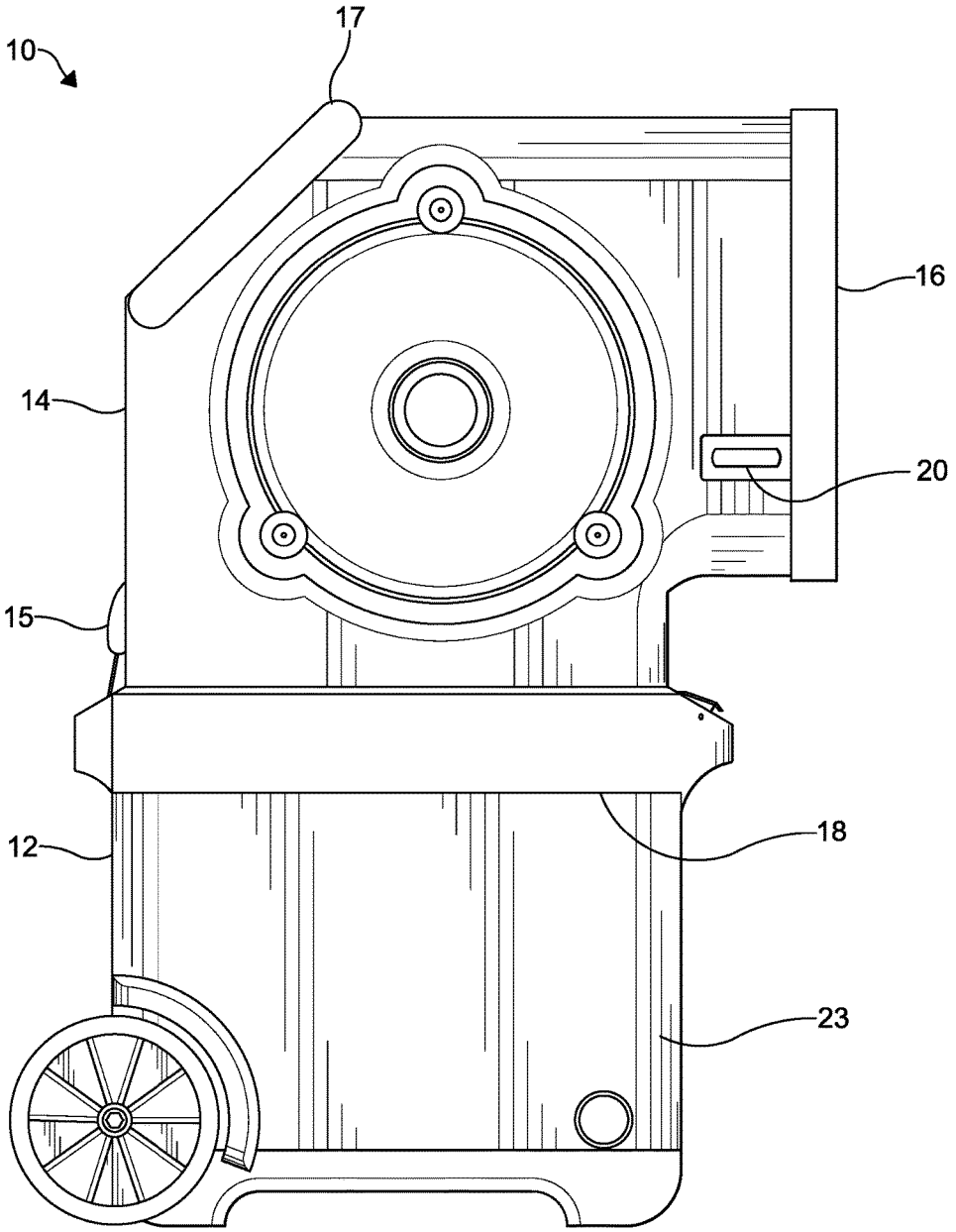
FIG. 1 is a front view, in elevation, of a loosefill insulation blowing machine.

The loosefill insulation blowing machine having a chute shape will now be described with occasional reference to specific embodiments. The loosefill insulation blowing machine having a chute shape may, however, be embodied in different forms and should not be construed as limited to the embodiments set forth herein. Rather, these embodiments are provided so that this disclosure will be thorough and complete, and will fully convey the scope of the loosefill insulation blowing machine having a chute shape to those skilled in the art.

Unless otherwise defined, all technical and scientific terms used herein have the same meaning as commonly understood by one of ordinary skill in the art to which the loosefill insulation blowing machine having a chute shape belongs. The terminology used in the description of the loosefill insulation blowing machine having a chute shape herein is for describing particular embodiments only and is not intended to be limiting of the loosefill insulation blowing machine having a chute shape. As used in the description of the loosefill insulation blowing machine having a chute shape and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the loosefill insulation blowing machine having a chute shape. Notwithstanding that the numerical ranges and parameters setting forth the broad scope of the loosefill insulation blowing machine having a chute shape are approximations, the numerical values set forth in the specific examples are reported as precisely as possible. Any numerical values, however, inherently contain certain errors necessarily resulting from error found in their respective measurements.

The description and figures disclose a loosefill insulation blowing machine having a chute shape. The chute is configured with a substantially uniform cross-sectional shape that closely approximates the cross-sectional size and shape of a received package of compressed loosefill insulation material. The substantially uniform cross-sectional shape of the chute results in a compact chute size and further results to direct the expansive force of compressed loosefill insulation material in a direction toward a shredding chamber.

The term "loosefill insulation material", as used herein, is defined to mean any insulating material configured for distribution in an airstream. The term "finely conditioned", as used herein, is defined to mean the shredding, picking apart and conditioning of loosefill insulation material to a desired density prior to distribution into an airstream.

Figure 2:
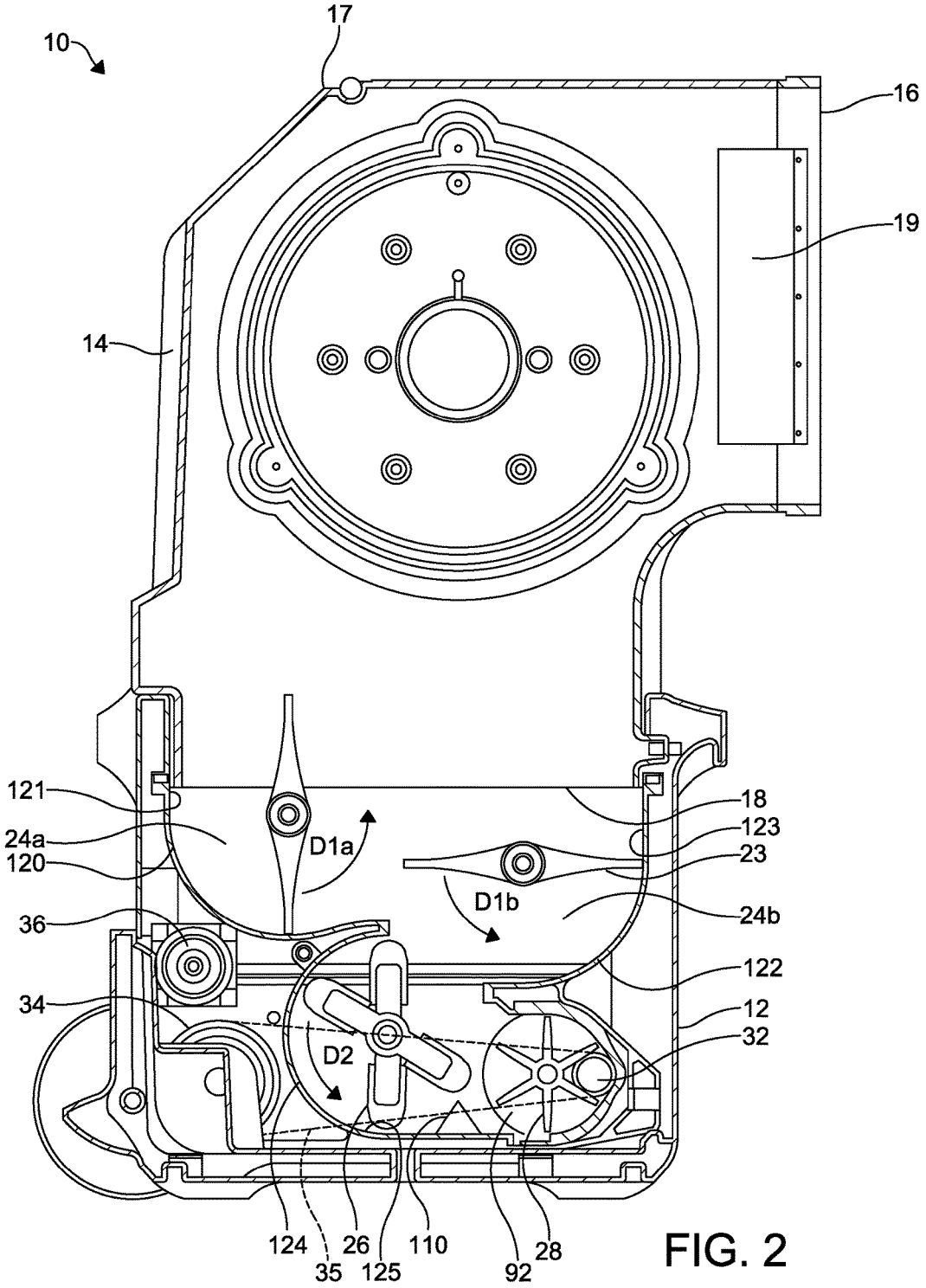
FIG. 2 is a front view, in elevation, partially in cross-section, of the loosefill insulation blowing machine of FIG. 1.
Figure 3:
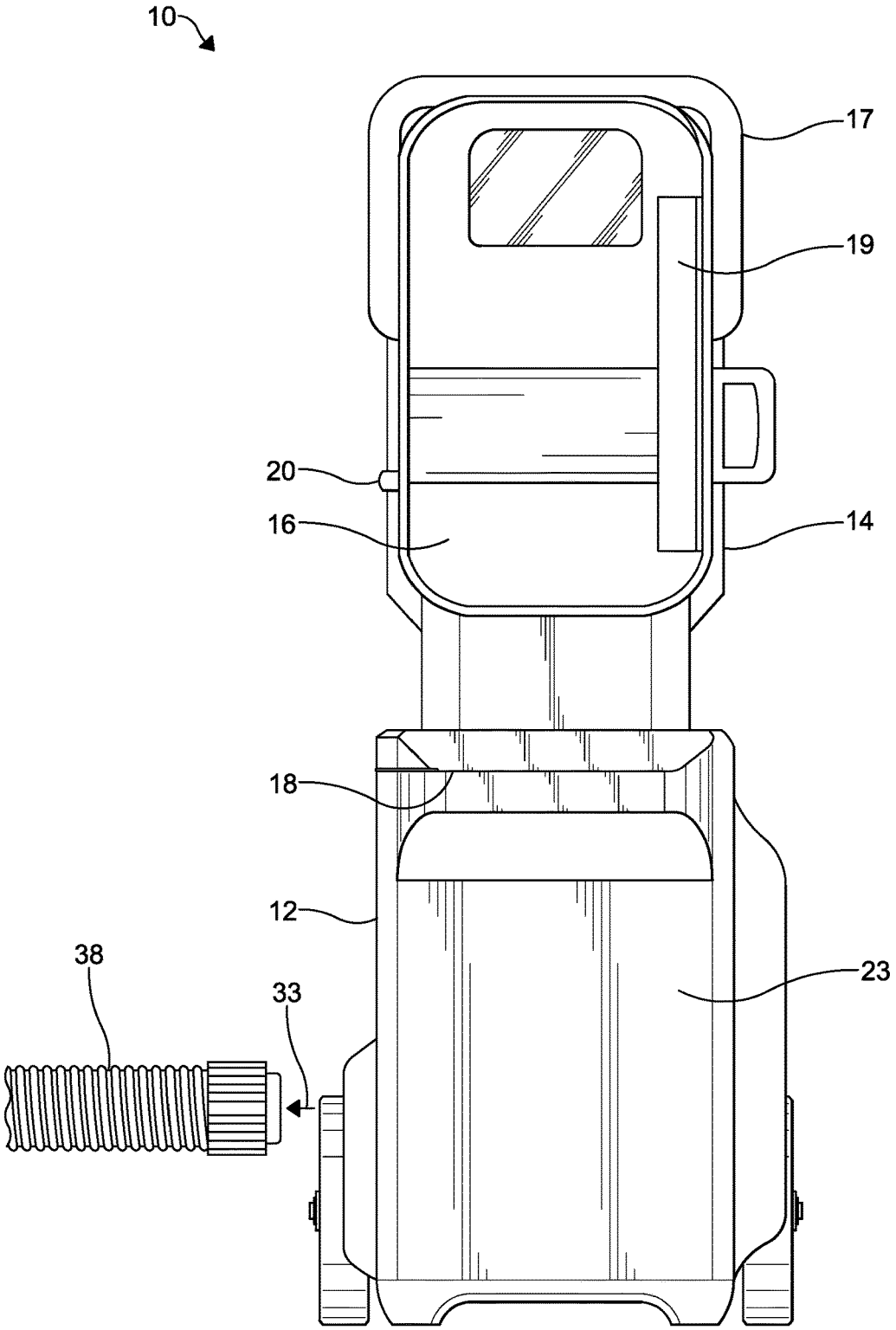
FIG. 3 is a side view, in elevation, of the loosefill insulation blowing machine of FIG. 1.

Referring now to FIGS. 1-3, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms 15, configured to readily assemble and disassemble the chute 14 to the lower unit 12. The chute 14 has an inlet portion 16 and an outlet portion 18.

Referring again to FIGS. 1-3, the inlet portion 16 of the chute 14 is configured to receive compressed loosefill insulation material typically contained within a package (not shown). As the package of compressed loosefill insulation material is guided within the interior of the chute 14, the cross-sectional shape and size of the chute 14 relative to the cross-sectional shape and size of the package of compressed loosefill insulation material directs the expansion of the compressed loosefill insulation material to a direction toward the outlet portion 18, wherein the loosefill insulation material is introduced to a shredding chamber 23 positioned in the lower unit 12.

Referring again to FIGS. 1-3, optionally the chute 14 can include one or more handle segments 17, configured to facilitate ready movement of the blowing machine 10 from one location to another. The handle segments 17 can have any desired structure and configuration. However, it should be understood that the one or more handle segments 17 are not necessary to the operation of the blowing machine 10.

Referring again to FIGS. 1, 2 and 3, the chute 14 includes a bail guide 19, mounted at the inlet portion 16 of the chute 14. The bail guide 19 is configured to urge a package of compressed loosefill insulation material against an optional cutting mechanism 20 as the package of compressed loosefill insulation material moves further into the interior of the chute 14.

Referring now to FIG. 2, the shredding chamber 23 is mounted in the lower unit 12 downstream from the outlet portion 18 of the chute 14. The shredding chamber 23 can include a plurality of low speed shredders 24*a*, 24*b* and one or more agitators 26. The low speed shredders 24*a*, 24*b* are configured to shred, pick apart and condition the loosefill insulation material as the loosefill insulation material is discharged into the shredding chamber 23 from the outlet portion 18 of the chute 14. The one or more agitators 26 are configured to finely condition the loosefill insulation material to a desired density as the loosefill insulation material exits the low speed shredders 24*a*, 24*b*. It should be appreciated that any quantity of low speed shredders and agitators can be used. Further, although the blowing machine 10 is described with low speed shredders and agitators, any type or combination of separators, such as clump breakers, beater bars or any other mechanisms, devices or structures that shred, pick apart, condition and/or finely condition the loosefill insulation material can be used.

Referring again to the embodiment shown in FIG. 2, the agitator 26 is positioned vertically below the low speed shredders 24*a*, 24*b*. Alternatively, the agitator 26 can be positioned in any location relative to the low speed shredders 24*a*, 24*b*, such as horizontally adjacent to the low speed shredders 24*a*, 24*b*, sufficient to finely condition the loosefill insulation material to a desired density as the loosefill insulation material exits the low speed shredders 24*a*, 24*b*.

In the embodiment illustrated in FIG. 2, the low speed shredders 24*a*, 24*b* rotate in a counter-clockwise direction, as shown by direction arrows D1*a*, D1*b* and the one or more agitators 26 also rotate in a counter-clockwise direction, as shown by direction arrow D2. Rotating the low speed shredders 24*a*, 24*b* and the agitators 26 in the same counter-clockwise directions, D1*a*, D1*b* D2, allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, the low speed shredders 24*a*, 24*b* and the agitators 26 could rotate in a clock-wise direction or the low speed shredders 24*a*, 24*b* and the agitators 26 could rotate in different directions provided an accumulation of unshredded or partially shredded loosefill insulation material does not occur in the shredding chamber 23.

Referring again to the embodiment shown in FIG. 2, the low speed shredders 24*a*, 24*b* rotate at a lower rotational speed than the agitator 26. The low speed shredders 24*a*, 24*b* rotate at a speed of about 40-80 revolutions per minute (rpm) and the agitator 26 rotates at a speed of about 300-500 rpm. In another embodiment, the low speed shredders can rotate at a speed less than about 40-80 rpm, provided the speed is sufficient to shred and pick apart the loosefill insulation material. In still other embodiments, the agitator 26 can rotate at a speed less than or more than 300-500 rpm provided the speed is sufficient to finely shred the loosefill insulation material and prepare the loosefill insulation material for distribution into an airstream.

Referring again to FIG. 2, the shredding chamber 23 includes a first guide shell 120 positioned partially around the low speed shredder 24*a*. The first guide shell 120 extends to form an arc of approximately 90°. The first guide shell 120 has an inner surface 121. The first guide shell 120 is configured to allow the low speed shredder 24*a* to seal against the inner surface 121 and thereby direct the loosefill insulation material in a downstream direction as the low speed shredder 24*a* rotates.

Referring again to FIG. 2, the shredding chamber 23 includes a second guide shell 122 positioned partially around the low speed shredder 24*b*. The second guide shell 122 extends to form an arc of approximately 90°. The second guide shell 122 has an inner surface 123. The second guide shell 122 is configured to allow the low speed shredder 24*b* to seal against the inner surface 123 and thereby direct the loosefill insulation material in a downstream direction as the low speed shredder 24*b* rotates.

Referring again to FIG. 2, the shredding chamber 23 includes a third guide shell 124 positioned partially around the agitator 26. The third guide shell 124 extends to form an approximate semi-circle. The third guide shell 124 has an inner surface 125. The third guide shell 124 is configured to allow the agitator 26 to seal against the inner surface 125 and thereby direct the finely conditioned loosefill insulation material in a downstream direction as the agitator 26 rotates.

In the embodiment shown in FIG. 2, the inner surfaces 121, 123 and 125, are formed from a high density polyethylene (hdpe) configured to provide a lightweight, low friction sealing surface and guide for the loosefill insulation material. Alternatively, the inner surfaces 121, 123 and 125 can be formed from other materials, such as aluminum, sufficient to provide a lightweight, low friction sealing surface and guide that allows the low speed shredders 24*a*, 24*b* or the agitator 26 to direct the loosefill insulation material downstream.

Referring again to FIG. 2, a discharge mechanism, shown schematically at 28, is positioned downstream from the one or more agitators 26 and is configured to distribute the finely conditioned loosefill insulation material exiting the agitator 26 into an airstream, shown schematically by arrow 33 in FIG. 3. In the illustrated embodiment, the discharge mechanism 28 is a rotary valve. In other embodiments, the discharge mechanism 28 can be other structures, mechanisms and devices, such as for example staging hoppers, metering devices or rotary feeders, sufficient to distribute the finely conditioned loosefill insulation material into the airstream 33.

Referring again to FIG. 2, the finely conditioned loosefill insulation material is driven through the discharge mechanism 28 and through a machine outlet 32 by the airstream 33. The airstream 33 is provided by a blower 34 and associated ductwork, shown in phantom at 35. In alternate embodiments, the airstream 33 can be provided by other structures and manners, such as by a vacuum, sufficient to provide the airstream 33 through the discharge mechanism 28.

Referring again to FIG. 2, the low speed shredders 24*a*, 24*b*, agitator 26 and discharge mechanism 28 are mounted for rotation. In the illustrated embodiment, they are driven by an electric motor 36 and associated drive means (not shown). However, in other embodiments, the low speed shredders 24*a*, 24*b*, agitator 26 and discharge mechanism 28 can be driven by any suitable means. In still other embodiments, each of the low speed shredders 24*a*, 24*b*, agitator 26 and discharge mechanism 28 can be provided with its own source of rotation. In the illustrated embodiment, the electric motor 36 driving the low speed shredders 24*a*, 24*b*, agitator 26 and discharge mechanism 28 is configured to operate on a single 15 ampere, 110 volt a.c. electrical power supply. In other embodiments, other power supplies can be used.

Referring again to FIG. 2, the discharge mechanism 28 is configured with a side inlet 92. The side inlet 92 is configured to receive the finely conditioned loosefill insulation material as it is fed in a substantially horizontal direction from the agitator 26. In this embodiment, the side inlet 92 of the discharge mechanism 28 is positioned to be horizontally adjacent to the agitator 26. In another embodiment, a low speed shredder 24*a* or 24*b*, or a plurality of low speed shredders 24*a*, 24*b* or agitators 26, or other shredding mechanisms can be horizontally adjacent to the side inlet 92 of the discharge mechanism 28 or in other suitable positions.

Referring again to FIG. 2, a choke 110 is positioned between the agitator 26 and the discharge mechanism 28. In this position, the choke 110 is configured to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning. In the illustrated embodiment, the choke 110 has a substantially triangular cross-sectional shape. However, the choke 110 can have other cross-sectional shapes sufficient to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning.

Referring again to FIG. 2, in operation, the inlet portion 16 of the chute 14 receives a package of compressed loosefill insulation material. As the package of compressed loosefill insulation material moves into the chute 14, the bale guide 19 urges the package against the cutting mechanism 20 thereby cutting an outer protective covering and allowing the compressed loosefill insulation within the package to expand. As the compressed loosefill insulation material expands from the cut package within the chute 14, the chute 14 directs the expanding loosefill insulation material past the outlet portion 18 of the chute 14 to the shredding chamber 23. The low speed shredders 24*a*, 24*b* receive the loosefill insulation material and shred, pick apart and condition the loosefill insulation material. The loosefill insulation material is directed by the low speed shredders 24*a*, 24*b* to the agitator 26. The agitator 26 is configured to finely condition the loosefill insulation material and prepare the loosefill insulation material for distribution into the airstream 33 by further shredding and conditioning the loosefill insulation material. The finely conditioned loosefill insulation material exits the agitator 26 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through a distribution hose 38 toward an insulation cavity.

Figure 4:
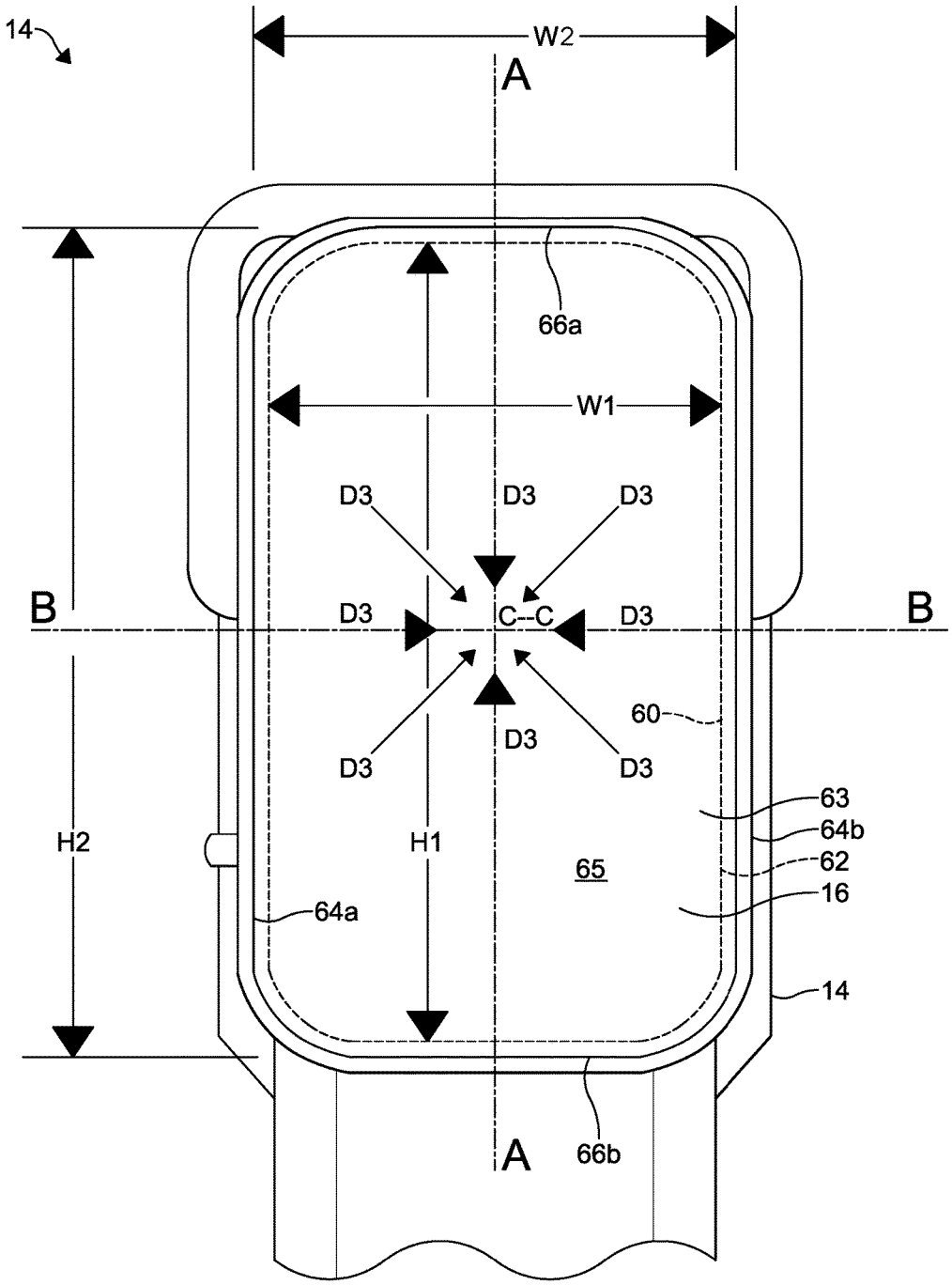
FIG. 4 is a side view, in elevation, of the inlet portion of the chute of the loosefill insulation blowing machine of FIG. 1.

Referring now to FIG. 4, a simplified view of the inlet portion 16 of the chute 14 is illustrated. The inlet portion 16 has a substantially rounded, rectangular cross-sectional shape and size that closely approximates the typical substantially rounded, rectangular cross-sectional shape and size of the package of compressed blowing insulation material, shown in phantom at 60.

Referring again to FIG. 4, the package 60 includes a protective outer covering 62, configured to encapsulate a body of compressed blowing insulation material 63. The protective outer covering is further configured to compress the blowing insulation material 63 in radially inward directions, as shown by direction arrows D3, with respect to a longitudinal axis C-C of the package 60.

Referring again to FIG. 4, the package 60 has a height H1 and a width W1. In the illustrated embodiment, the height H1 is about 19.0 inches and the width W1 is about 8.0 inches. However, in other embodiments, the height H1 can be more or less than about 19.0 inches and the width W1 can be more or less than about 8.0 inches. A package having a height H1 of about 19.0 inches and width W1 of 8.0 inches might have a weight of about 35.0 pounds.

Referring again to FIG. 4, the inlet portion 16 of the chute has a height H2 and a width W2. As noted above, the cross-sectional shape and size of the inlet portion 16 closely approximates the cross-sectional shape and size of the package of compressed blowing insulation material 60. Accordingly, for the package 60 specified above, the inlet portion 16 of the chute 14 has a height H2 of about 20.0 inches and a width W2 of about 9.0 inches. The substantially similar cross-sectional shape and size of the inlet portion 16 of the chute 14 allows the package 60 to be easily received and fed into the chute 14. As will be discussed in more detail below, by providing the inlet portion 16 of the chute 14 with a substantially similar cross-sectional shape and size of the package 60, certain expansive forces of the compressed loosefill insulation material within the package 60 will be substantially contained when the outer protective covering 62 is cut, thereby preventing the expansion of the loosefill insulation material in certain directions.

Referring again to FIG. 4, the inlet portion 16 of the chute 14 includes longitudinal sides 64*a*, 64*b* and lateral sides 66*a*, 66*b*. The longitudinal sides 64*a*, 64*b* of the inlet portion 16 of the chute 14, are configured to be substantially vertical and centered about major longitudinal axis A-A. The lateral sides 66, 66*b* are configured to be substantially horizontal and centered about major lateral axis B-B. In the illustrated embodiment, the package 60 of compressed loosefill insulation material is fed into the inlet portion 16 of the chute 14 in a manner such that the package 60 has a substantially vertical orientation. The term "vertical orientation", as used herein, is defined to mean a face of the package 60 having a width of 8.0 inches is adjacent to the lateral side 66*b*. Alternatively, the chute 14 can be configured such that the package 60 has a substantially horizontal orientation when fed into the inlet end 16 of the chute 14.

Figure 5:
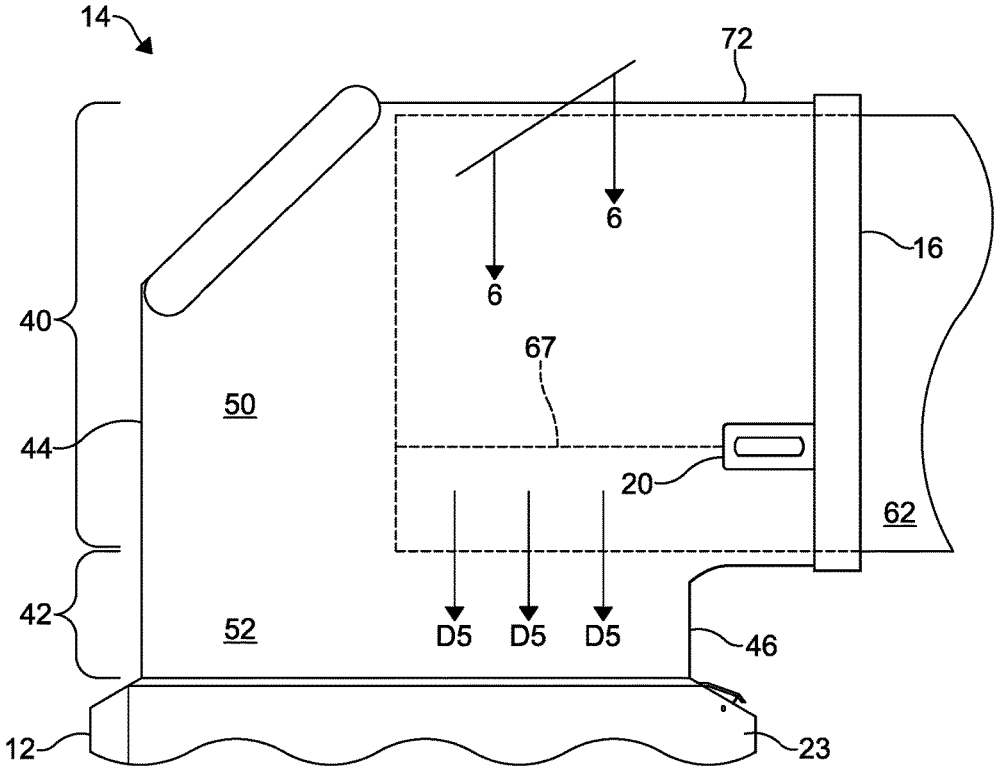
FIG. 5 is a front view, in elevation, partially in cross-section, of the chute of the loosefill insulation blowing machine of FIG. 1.

Referring now to FIG. 5, a simplified, partial cross-sectional view of the chute 14 is illustrated. The chute 14 includes the inlet portion 16 and the cutting mechanism 20. The chute 14 also includes an upper portion 40 and a throat portion 42. The upper portion 40 extends in a horizontal direction from the inlet portion 16 to a side wall 44 and in a vertical direction from a top wall 72 to the throat portion 42. The throat portion 42 extends in a horizontal direction from a first throat wall 46 to the side wall 44 and in a vertical direction from the upper portion 40 to the lower unit 12. The upper portion 40 forms a first cavity 50 therewithin and the throat portion 42 forms a second cavity 52 therewithin.

Figure 6:
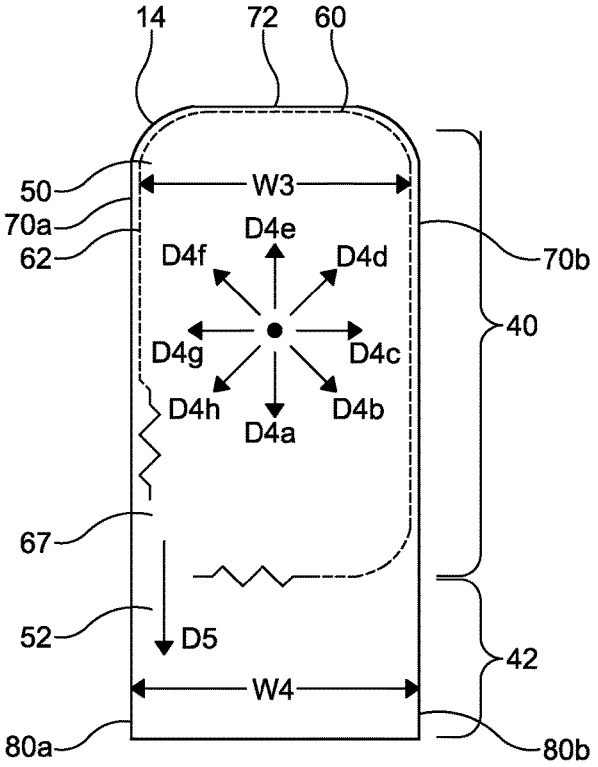
FIG. 6 is a cross-sectional view, in elevation, taken along the lines 6-6 of the chute of FIG. 5.

Referring now to FIG. 6, a cross-sectional view of the chute 14 taken at 6-6 is illustrated. The chute 14 includes the upper portion 40, throat portion 42, first cavity 50 and second cavity 52 are illustrated. The upper portion 40 is bounded by side walls 70*a*, 70*b* and a top wall 72. The side walls 70*a*, 70*b* form a width W3 of the upper portion 40. In the illustrated embodiment, the width W3 of the upper portion 40 of the chute 14 is the same as the width W2 of the inlet portion 16 of the chute 14. Accordingly, both of the widths W2, W3 are sized to closely approximate the cross-sectional shape and size of the package 60 of compressed blowing insulation material.

The throat portion 42 is also bounded by side walls 70*a*, 70*b*. The side walls 70*a*, 70*b* form a width W4 of the throat portion 40. In the illustrated embodiment, the width W4 of the throat portion 42 of the chute 14 is the same as the width W2 of the inlet portion 16 of the chute 14 and the width W3 of the upper portion 40 of the chute. Accordingly, the widths W2, W3 and W4 are sized to closely approximate the cross-sectional shape and size of the package 60 of compressed blowing insulation material.

Referring again to FIGS. 5 and 6, in operation the package 60 of compressed blowing insulation material is urged into the inlet portion 16 of the chute 16. As the package 60 enters the inlet portion 16 of the chute 14, the blowing insulation material 65 contained within the protective covering 62 of the package 60 is in a radially compressed configuration as shown in FIG. 4. Referring again to FIGS. 5 and 6, as the package 60 is moved further into the chute 16, the cutting mechanism 20 cuts the outer protective covering 62, thereby forming an opening 67 in a lower side of the outer protective covering 62 of the package 60. As the opening 67 is formed, the compressed blowing insulation material 65 expands in radial directions, as shown by direction arrows D4*a*-D4*h* in FIG. 6. Due to the close approximate cross-sectional shape and size of the package 60 and the inlet and upper portions 16, 40 of the chute 14, the radial expansion of the compressed blowing insulation material 65 in horizontal directions D4*b*, D4*c*, D4*d*, D4*f*, D4*g* and D4*h* and upwardly vertical direction D4*e* are contained by side walls 70*a*, 70*b* and the top wall 72 of the upper portion 40 of the chute 14. However, the expansion of the compressed blowing insulation material 65 in a downward direction D5 toward the toward a shredding chamber 23, is unconstrained.

Referring again to FIGS. 5 and 6, since the width W4 of the throat portion 42 is consistent with the width W3 of the upper portion 40, the constraint of the expansion of the compressed blowing insulation material 65 in the horizontal directions D4*b*, D4*c*, D4*d*, D4*f*, D4*g* and D4*h* by the side walls 70*a*, 70*b* continues as the expanding blowing insulation material enters the throat portion 42 of the chute 14. As a result of the constrained expansion of the compressed blowing insulation material 65 in directions D4*b*, D4*c*, D4*d*, D4*f*, D4*g*, D4*h* and D4*e* in the upper and throat portions 40, 42, the expansion of the compressed blowing insulation material 65 occurs in direction D5, toward the shredding chamber 23.

Without being held to the theories, it is believed that the combination of the vertical orientation of the package of compressed loosefill insulation material 60, as it is fed into the inlet portion 16 of the chute 14, and the controlled and directed expansion of the compressed loosefill insulation material toward the shredding chamber 23 provides many benefits, although all benefits may not be present in all embodiments. First, a desired high throughput can be realized as the directed expansion of the compressed loosefill insulation material can be used to increase the feed rate of the loosefill insulation material through the blowing machine 10. The term "throughput", as used herein, is defined to mean the amount of loosefill insulation material conditioned and distributed by the blowing machine 10 per unit of time. Second, a high shredding efficiency can be realized. The term "shredding efficiency", as used herein, is defined to mean the amount of conditioning incurred by a unit of loosefill insulation material per rotation of a shredder. Third, unwanted accumulations of loosefill insulation material in the chute can be substantially prevented by directing the expanding loosefill insulation material in the desired downward direction. Finally, the substantially uniform cross-sectional shape of the chute results in a compact chute size and a corresponding reduction in the overall size of the blowing machine 10. The reduction in the overall size of the blowing machine 10 enables ease of transportation by a user and further enables ease of storage.

The principle and mode of operation of the loosefill insulation blowing machine having a chute shape have been described in certain embodiments. However, it should be noted that the loosefill insulation blowing machine having a chute shape may be practiced otherwise than as specifically illustrated and described without departing from its scope.

What is claimed is:

1. A machine for distributing blowing insulation material from a package of compressed loosefill insulation material, the machine comprising:

a chute having an inlet portion an upper portion and a throat portion, the inlet portion configured to receive the package of compressed loosefill insulation material, the package having compressed loosefill insulation material within an outer protective covering, the inlet portion having a width and further having a vertically oriented, rectangular cross-sectional shape and size, the upper portion extending in a horizontal direction from the inlet portion to a sidewall and in a vertical direction from a top wall to the throat portion, and the upper portion having a vertically oriented, rectangular cross-sectional shape and size that closely corresponds to a vertically oriented, rectangular cross-sectional shape and size of the package of compressed loosefill insulation material, the upper portion further having a width and the throat portion of the chute having a width, and wherein the inlet portion, upper portion and throat portion define the flow of the compressed loosefill insulation material and the widths of the inlet portion, upper portion and throat portion are equal to each other, the chute further including a cutting mechanism configured to cut the outer covering of the package; and a lower unit configured to receive the compressed loosefill insulation material exiting the package and the chute, the lower unit including a plurality of shredders and a discharge mechanism, the discharge mechanism configured to discharge conditioned loosefill insulation material into an airstream;

wherein the vertically oriented, rectangular cross-sectional shape and size of the inlet portion and the upper portion direct an expansive force of the compressed loosefill insulation material in a direction toward the lower unit.

2. The machine of claim 1, wherein the cross-sectional shape of the inlet portion is a rectangle having rounded corners.

3. The machine of claim 1, wherein the cross-sectional shape of the upper portion is a rectangle having rounded corners.

4. The machine of claim 1, wherein opposing longitudinal walls forming the inlet portion have a vertical orientation and opposing lateral walls forming the inlet portion have a horizontal orientation.

5. The machine of claim 4, wherein the package of compressed loosefill insulation material has a width of 8.0 inches and a height of 19.0 inches.

6. The machine of claim 1, wherein the package of compressed loosefill insulation material is is packaged with a compression ratio of at least about 10:1.

7. A machine for distributing blowing insulation material from a package of compressed loosefill insulation material, the machine comprising:

a chute having an inlet portion, an upper portion and a throat portion, the inlet portion configured to receive the package of compressed loosefill insulation material, the package having compressed loosefill insulation material within an outer protective covering, the inlet portion having a width and further having a vertically oriented, rectangular cross-sectional shape and size, the upper portion extending in a horizontal direction from the inlet portion to a sidewall and in a vertical direction from a top wall to the throat portion, and the upper portion having a vertically oriented, rectangular cross-sectional shape and size that closely corresponds to a vertically oriented, rectangular cross-sectional shape and size of the package of the compressed loosefill insulation material, the upper portion further having a width and the throat portion of the chute having a width, and wherein the inlet portion, upper portion and throat portion define the flow of the compressed loosefill insulation material and the widths of the inlet portion, upper portion and throat portion are the same dimensions, the chute further including a cutting mechanism configured to cute the outer covering of the package; and a lower unit configured to receive the compressed loosefill insulation material exiting package and the chute, the lower unit including a plurality of shredders and a discharge mechanism, the discharge mechanism configured to discharge conditioned loosefill insulation material into an airstream;

wherein the vertically oriented, rectangular cross-sectional shape and size of the inlet portion and the upper portion direct an expansive force of the compressed loosefill insulation material in a direction toward the lower unit.

8. The machine of claim 7, wherein the cross-sectional shape of the inlet portion is a rectangle having rounded corners.

9. The machine of claim 7, wherein the cross-sectional shape of the throat portion is a rectangle having rounded corners.

10. The machine of claim 7, wherein opposing longitudinal walls forming the inlet portion have a vertical orientation and opposing lateral walls forming the inlet portion have a horizontal orientation.

11. The machine of claim 10, wherein the package of compressed loosefill insulation material has a width of 8.0 inches and a height of 19.0 inches.

12. The machine of claim 7, wherein the package of compressed loosefill insulation material is is packaged with a compression ratio of at least 10:1.

* * * * *